US006599466B1

(12) United States Patent
Moxson et al.

(10) Patent No.: US 6,599,466 B1
(45) Date of Patent: Jul. 29, 2003

(54) MANUFACTURE OF LIGHTWEIGHT METAL MATRIX COMPOSITES WITH CONTROLLED STRUCTURE

(75) Inventors: Vladimir S. Moxson, Hudson, OH (US); Eugene Ivanov, Grove City, OH (US)

(73) Assignee: ADMA Products, Inc., Twinsburg, OH (US)

( * ) Notice: Subject to any disclaimer, the term of this patent is extended or adjusted under 35 U.S.C. 154(b) by 0 days.

(21) Appl. No.: 10/046,598

(22) Filed: Jan. 16, 2002

(51) Int. Cl.[7] ..... B22F 3/24; B22F 3/26
(52) U.S. Cl. ..... 419/27; 419/29
(58) Field of Search ..... 419/27, 29

(56) References Cited

U.S. PATENT DOCUMENTS

| | | | | |
|---|---|---|---|---|
| 3,718,441 | A | 2/1973 | Landingham | 29/182 |
| 4,381,942 | A | 5/1983 | Blum et al. | 419/23 |
| 4,699,849 | A | 10/1987 | Das | 428/698 |

(List continued on next page.)

FOREIGN PATENT DOCUMENTS

| | | | |
|---|---|---|---|
| DE | 19917175 | 10/2000 | B22D/19/00 |
| EP | 408257 | 1/1991 | C22C/1/09 |
| EP | 765946 | 4/1997 | C22C/1/09 |

(List continued on next page.)

OTHER PUBLICATIONS

"Processing of complex shaped MMC products through sintering by infiltration" Domsa S. and Orban R. *ECCM–8, Eur. Conf. Compos.Mater.*, vol. 4, 1998, p. 107–112.

"Production of $Al/Al_3Ti$ composites by low pressure casting–combustion synthesis process" Mizuuchi K., et al., *Nippon Kinzoku Gakkaishi, 1998 62*(*6*), p. 551–556.

"Light–weight Ti–Mg alloys by vapor deposition" Ward–Close C., et al., *Syntesis/Processing of Light–weight Metal Materials. Proc. Symp.*, 1995, p. 107–118.

(List continued on next page.)

*Primary Examiner*—Daniel J. Jenkins

(57) ABSTRACT

Lightweight metal matrix composites containing a skeleton structure of titanium, titanium aluminide, or Ti-based alloy are manufactured by low temperature infiltration with molten Mg-based alloy or Mg—Al alloy at 450–750° C., with molten In, Pb, or Sn at 300–450° C., or with molten Ag and Cu at 900–1100° C. The skeleton structure with a density of 25–35% is produced by loose sintering of Ti or Ti-based alloy powders. A primary deformation of the Ti skeleton structure before the infiltration is carried out by cold or hot rolling or forging to obtain a porous flat or shaped preform with a porosity <50% and pores drawn out in one direction such as the direction of future rolling of the composite plate. A secondary deformation of the infiltrated preform is carried out by multistage cold, or especially hot rolling, to refine the microstructure of the infiltrated skeleton structure and transform it into the textured microstructure strengthened by intermetallic phases such as TiAl, $Ti_3Al$, and $TiAl_3$. Subsequent re-sintering or diffusion annealing form a fully dense final structure of the resulting material having improved mechanical properties. The molten Mg-based infiltrate is alloyed with Al, Si, Zr, Nb, and/or V with the addition of $TiB_2$, SiC, and $Si_3N_4$ sub-micron particles as infiltration promoters. The molten Agcomer- or Cu-based infiltrate can be alloyed with elements depressing its melting point. The method allows for control of the microstructure of composite materials by changing parameters of deformation, infiltration, and heat treatment. The method is suitable for the manufacture of flat or shaped metal matrix composites having improved ductility, such as lightweight bulletproof plates and sheets for aircraft and automotive applications, composite electrodes, heat-sinking lightweight electronic substrates, sporting goods such as helmets, golf clubs, sole plates, crown plates, etc.

11 Claims, 1 Drawing Sheet

U.S. PATENT DOCUMENTS

| | | | | |
|---|---|---|---|---|
| 4,725,567 | A | 2/1988 | Hillig | 501/87 |
| 4,861,373 | A | 8/1989 | Klar et al. | 75/244 |
| 4,894,158 | A | 1/1990 | Morita et al. | 210/497.2 |
| 5,197,528 | A | 3/1993 | Burke | 164/97 |
| 5,260,137 | A | 11/1993 | Rosenthal et al. | 428/608 |
| 5,311,919 | A | 5/1994 | Aghajanian et al. | 164/97 |
| 5,366,686 | A | 11/1994 | Mortensen et al. | 419/5 |
| 5,425,494 | A | 6/1995 | Rosenthal et al. | 228/124.5 |
| 5,697,421 | A | 12/1997 | Lin et al. | 164/105 |
| 5,705,229 | A | 1/1998 | Abiven et al. | 427/431 |
| 5,770,821 | A | 6/1998 | Hikasa et al. | 174/264 |
| 5,890,530 | A | 4/1999 | Schmitt | 164/98 |
| 5,980,602 | A | 11/1999 | Carden | 75/236 |
| 5,983,507 | A | 11/1999 | Hirai | 30/350 |
| 5,989,489 | A | * 11/1999 | Stuvinga et al. | 419/6 |
| 6,200,526 | B1 | 3/2001 | Fox | 75/26 |
| 6,264,719 | B1 | 7/2001 | Zhang et al. | 75/252 |
| 6,287,433 | B1 | 9/2001 | Sapozhnikova | 204/293 |

FOREIGN PATENT DOCUMENTS

| | | | |
|---|---|---|---|
| GB | 2302336 | 1/1997 | C22C/1/00 |
| JP | 60070143 | 4/1985 | C22C/1/02 |
| JP | 01279715 | 11/1989 | C22C/1/09 |
| JP | 01279720 | 11/1989 | C22C/1/09 |
| JP | 01279721 | 11/1989 | C22C/1/09 |
| JP | 03207829 | 9/1991 | C22C/1/09 |
| JP | 09263858 | 10/1997 | C22C/1/09 |
| JP | 2000271728 | 10/2000 | B22D/19/14 |
| WO | WO 9117278 | 11/1991 | |
| WO | WO 9421407 | 9/1994 | B22F/3/00 |

OTHER PUBLICATIONS

Metal Handbook, 9$^{th}$ edition, v.7, American Society for Metals, Materials Park, Ohio, 1984.

"Powder Metallurgy of Titanium Alloys" F.H. Froes and D. Eylon, *International Material Reviews, 1990*, vol. 35, No. 3, p. 162–182.

"The fabrication of metal matrix composities by a presureless infiltration" Aghajanian M.K., et al., *J. of Material Science, 1991, 26* (*20*, p. 447–454.

* cited by examiner

MANUFACTURE OF LIGHTWEIGHT METAL MATRIX COMPOSITES WITH CONTROLLED STRUCTURE

FIELD OF INVENTION

The present invention relates to metal matrix composites (MMC) manufactured by methods of powder metallurgy especially by infiltrating a loose sintered solid metal powder with low-melting liquid metal or alloy. More particularly, the invention is directed to MMC containing at least one component (solid powder or infiltrating melt) based on lightweight metals such as titanium and magnesium.

BACKGROUND OF THE INVENTION

Metal matrix composites manufactured by infiltrating with molten metal are attractive materials for structural applications not only due to their excellent properties such as stiffness, light weight, high abrasion and oxidation resistance but mainly due to the opportunity to compose materials containing combinations of metals that can be difficult or cost prohibitive when produced by methods of conventional metallurgy and machining.

However, infiltrated MMC (IMMC) are usually brittle, weak at high temperatures, and exhibit insufficient flexure, fatigue, and impact strengths. Low dynamic mechanical properties limit the application of IMMC especially in aircraft, automotive, and rocket industries.

Various processes have been developed during the last two decades for the fabrication of lightweight IMMC with desirable mechanical properties including vacuum infiltration, low-pressure casting, liquid-phase sintering and self-propagating combustion synthesis among others. All of these new processes as well as conventional powder metallurgy techniques impose certain limitations with respect to the characteristics of the produced IMMC.

For example, JP 60070143, 1985, describes the process of formation of a titanium-magnesium composite by compacting a porous titanium block immersed with the molten Mg at high pressure. The high pressure is needed to provide infiltrating due to a lack of wetting titanium by molten Mg. The porous Ti block should have a relatively high density to be able to hold the high pressure processing, so the block has low porosity. Low porosity limits the amount of infiltrated Mg and therefore limits the ultimate weight decrease. Besides, low porosity results in the incomplete infiltration of small porous channels by magnesium. Even long holding time does not help, and the final structure has a remaining porosity in the central part of the block. This randomly distributed porosity and heterogeneous structure of dense titanium skeleton decrease mechanical properties of the obtained IMMC, especially impact strength and toughness.

From the other hand, the high pressure infiltration of ceramic matrix composites (German patent 19917175, 2000) allows the use of a relatively high level of porosity (~35%) that results in complete filling of pores by molten metal. But ceramic matrix composites have significantly lower elasticity and impact strength than the projected IMMC. So, the degree of IMMC porosity must be in the controlled range that is not provided by conventional technique.

Besides, it is technically difficult to organize high pressure evenly distributed on the area of large size porous blanks such as plates, sheets, and the like.

The addition of infiltrating enhancers such as ZnO or MgN, as disclosed in U.S. Pat. No. 5,311919, is effective in speeding up the infiltration process and filling out all cavities in the compacted Ti block. However, this method does not improve any mechanical characteristics of the final product due to oxide or nitride intrusions acting as stress concentrators in the composite microstructure. The U.S. Pat. No. 5,890,530 describes the Mg infiltration process in the presence of an oxygen-binding material such as carbon or graphite. This method is not effective if the infiltrated compact is manufactured from titanium or zirconium as they are oxygen-active metals themselves. Besides, carbon-based additives also deteriorate microstructure of IMMC.

The applied vacuum improves the infiltration conditions of molten Al, Mg, Ni, and other metals into a porous ceramic compact under a vacuum of $<10^{-6}$ torr as it is reported in the U.S. Pat. No. 3,718,441. However, the absence of pressure does not produce the beneficial effects on the composite structure as well as the high pressure in the above mentioned methods.

Several attempts have been tried to improve a spontaneous infiltration by alloying Mg-based melt with such elements as Al, Zr, or Zn, for instance, in EP 765946, 1997, and WO 9117278, 1991, or JP 01279715, 1989, or JP 09263858, 1997. The infiltration and consequently the density of composites were improved but mechanical properties remained at the same low level because the structure of the final composites were not really changed.

The MMC based on Ti—Ag and Ti—Cu compositions were not manufactured by spontaneous infiltration or infiltration under gas pressure. High temperature of the infiltration process caused by high melting point of silver and copper result in their active reaction with titanium and formation of monolith casting structure. That's why, those compositions are used as brazing filler metals for titanium joining.

Some specialized technologies were offered to manufacture MMC structure without the formation of casting structures, e.g., (a) small amount of silver powder is mixed with Ti powder and sintered together at the temperature over the melting point of silver (as in U.S. Pat. No. 5,983,507), or (b) coating titanium powder by copper and sintered at the temperature over the melting point of copper (as in U.S. Pat. No. 4,381,942). Both those technologies can not provide fully dense uniform structure of MMC, and therefore, can not provide a stability of mechanical properties of the composite materials.

The infiltration of sintered titanium powder preform with low-melting metal, e.g., lead, at 600° C. (as described in the U.S. Pat. No. 6,287,433) results also in residual porosity and insufficient strength of the obtained composite plates.

All other known processes of making IMMC have the same drawback: the irregular structure (consisting of the sintered skeleton, casting infiltrate, and residual pores) results in low mechanical properties of the composite.

OBJECTS OF THE INVENTION

It is therefore an object of the invention to form an homogeneous, essentially uniform structure of the metal matrix composites providing significant increases of such mechanical characteristics as elongation, toughness, flexure and impact strength or fatigue resistance.

Another object of the present invention is control of the IMMC structure by the formation of the predetermined structure of the compacted preform, and then, a texture in the infiltrated composite that will allow for the control of mechanical properties in the final product.

It is yet another object to provide complete wetting of the surface of titanium powder in the skeleton structure during the infiltration with the Mg-base alloys, Ag- and Cu-based alloys, or Pb to achieve full density of the composite material.

It is still another object of the invention to generate intermetallic compounds on the interface of the titanium matrix and the infiltrated alloy and to achieve the effect of strengthening of the final microstructure by the intermetallics.

A further object of the invention is to ultimately provide for articles, esp. metal composite foils, plates and sheets, that are fully dense and characterized by high mechanical properties.

It is yet another object of the invention to generate low thermal expansion materials with heat-dissipating structure for electronic substrate applications.

The nature, utility, and further features of this invention will be more clearly apparent from the following detailed description with respect to preferred embodiments of the invented technology.

SUMMARY OF THE INVENTION

The invention relates to the manufacture of metal matrix composites by loose sintering titanium, titanium aluminide, or titanium alloy powder in the lightweight skeleton structures and by infiltrating them with a molten metal. While the use of Mg-based infiltrates has previously been contemplated in the composite production, as mentioned above, problems related to insufficient wetting, defective microstructure, residual porosity, and low mechanical properties of Ti-matrix composites have not been solved.

The invention overcomes these problems by (1) loose sintering of Ti-based powder to obtain the skeleton structure having a density of 25–35% or sintering of direct powder rolled strip to obtain the skeleton structure having a porosity of 35–60%, (2) deformation of said skeleton structure before the infiltration to obtain a preform having density of 45–90% with the predetermined shape and size of pores, (3) alloying magnesium with Al, Ti, Si, Zr, Nb and V, (4) modification of Mg—Al-based melt with sub-micron particles of $TiB_2$, SiC, or $Si_3N_4$, (5) infiltration with Mg—Al-based melt at 450–750° C., or with molten In, Pb, or Sn at 300–450° C., or with molten Ag and Cu alloy at 900–1100° C. followed by (6) rolling, die pressing, CIP, cold and preferably, hot deformation, to refine and transform casting microstructure of the infiltrated metal into the deformation microstructure strengthened by intermetallic phases such as TiAl, $TiAl_3$, and $Ti_3Al$, and (7) final re-sintering or diffusion annealing.

In another aspect of the invention there is provided a technology to manufacture fully dense flat or shaped lightweight construction articles based on Ti—Mg, Ti—Mg—Al, or Ti—Pb, Ti—Ag, and Ti—Cu infiltrated metal matrix composites.

In essence, the core of the invention is to control the composite microstructure using (a) loose sintering, (b) customized deformation before and after the infiltration, (c) alloying or modifying the infiltrated metal, and (d) heat treatment realizing dispersion-strengthening. The controlled microstructure results in significant improvement of mechanical properties of the composite material.

The method allows the control of the microstructure of the composite materials by changing parameters of deformation, infiltration, and heat treatment. The method is suitable for the manufacture of flat or shaped metal matrix composites having improved ductility such as lightweight bulletproof plates and sheets for aircraft and automotive applications, composite electrodes, heat-sinking lightweight electronic substrates, as well as for sporting goods such as helmets, golf clubs, sole plates, crown plates, etc.

DETAILED DESCRIPTION AND PREFERRED EMBODIMENTS OF THE INVENTION

The wettability of the Ti-skeleton structure is achieved by alloying magnesium with aluminum as a main component up to 70 wt. %, and with 1–4 wt. % of Ti, Si, Zr, Nb, and/or V which form chemical compounds or solid solutions with the titanium matrix and with aluminum. The enhanced wettability provides a complete filling of all open pore channels by the infiltrated melt independent of the pore size.

Besides, these additives generate dispersed intermetallics such as silicides and aluminides after solidification of the infiltrated alloy. The size of these intermetallic intrusions is regulated by subsequent sintering and diffusion annealing, therefore, the formation of such dispersed hard microparticles is one way among others to control the microstructure and mechanical properties of the composite material.

The alloying with aluminum plays an especially important role because results in an infiltrated Mg—Al alloy with a relatively low melting point, e.g., in the range of 450–550° C., that significantly simplifies the infiltrating technology. Any addition of aluminum up to 65 wt. % decreases both solidus and liquidus temperatures of Mg as it is shown on the Mg—Al phase diagram. But also, there is another function for Al in this system (beside decreasing melting point of the infiltrated metal) to provide wetting of the titanium matrix by Mg-rich melt. Magnesium does not form either chemical compounds or solid solutions with titanium and consequently results in poor wetting of the Ti surface by Mg melt at temperatures below 1200° C. In this situation, aluminum reacting with titanium improves wetting of the Mg-rich melt starting already from a small addition, e.g., 1 wt. % of Al. The alloying Mg melt with a 10 wt. % of Al or more provides sufficient wetting of pore surfaces in the titanium compacted matrix.

The nanosized $TiB_2$, SiC, or $Si_3N_4$ particles are added into the infiltrated metal to promote the infiltration of small pores especially on the surface of the Ti matrix. The use of such particles is effective because these ceramics exhibit active contact reactions and wetting by Al-containing metal melts. A dense surface of the IMMC is very important to avoid an initiation of surface microcracks in regard to consequent deformation according to our invention.

Figure 1:
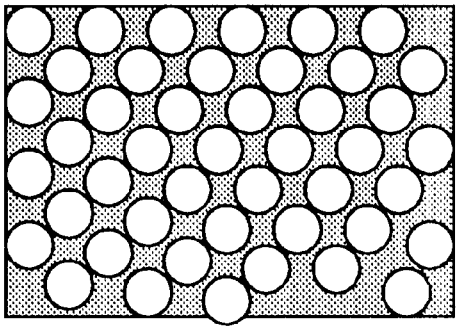
FIG. 1 is a diagram of a cross-sectional view of the skeleton structure of a loose sintered preform.
Figure 2:
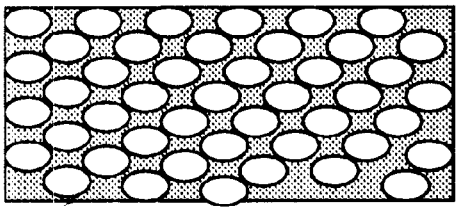
FIG. 2 is a diagram of a cross-sectional view of the skeleton structure deformed before the infiltration.
Figure 3:
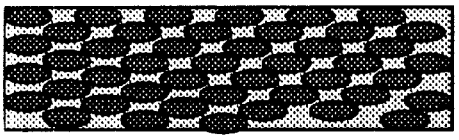
FIG. 3 is a diagram of a cross-sectional view of deformed and infiltrated skeleton structure.
Figure 4:
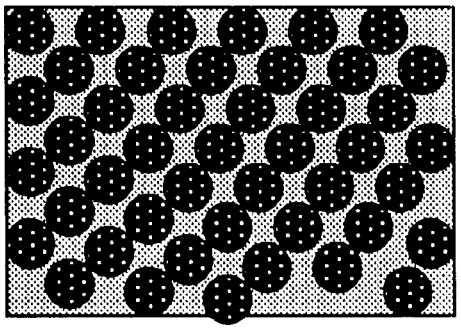
FIG. 4 is a diagram of a cross-sectional view of the infiltrated skeleton structure without the primary deformation.

The deformation of the processed material is carried out in two steps: before and/or after the infiltration. The first deformation has as its aim to condense the compacted Ti powder preform and decrease porosity after loose sintering, e.g., to 50%. Another goal of this step of the deformation is to obtain pores with the predetermined shape before the infiltration, e.g., all pores drawn out in one direction such as the direction of future rolling of the composite plate (FIG. 2). The infiltrated preform manufactured in such manner has already a sort of preliminary texture that can be transformed in the final textured microstructure of the composite after the second step of deformation. So, the deformation before the infiltration is the first procedure to control the final microstructure of the IMMC. This deformation may be performed in several runs to reach a desirable deformation level without destruction of the brittle preform.

Strong skeleton structure obtained after the first deformation allows to accomplish high temperature infiltration by silver and copper without destroying the skeleton body and without formation the casting monolith. Casting structures are formed only on the surface of the infiltrated preforms. Those casting defects can be removed easily by grinding, if necessary.

The molten Ag- or Cu-based infiltrate can be alloyed with elements depressing its melting point. For instance, Ag—Cu eutectic alloy containing 28 wt. % of Cu or alloy containing (in wt. %) 35Ti—35Zr—30Cu can be used for infiltration at 900° C. and 920° C. respectively.

Figure 5:
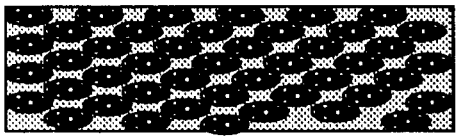
FIG. 5 is a diagram of a cross-sectional view of the infiltrated and deformed composite structure strengthened with intermetallics and nanosized ceramic particles.

The deformation after the infiltration is the advanced procedure to control the final microstructure. This step of deformation serves the purpose of achieving full densification of the composite metal and the final texture in a desirable direction, and to refine the microstructure of the infiltrated metal and transform it into the textured microstructure strengthened by dispersed intermetallic phases (FIG. 5).

For instance, if we infiltrate Ti skeleton structure with the Mg—Al melt at 500° C., the reaction between Al and Ti is not completed at the low temperature. On the one hand, we alloyed magnesium especially to decrease the infiltration temperature and prevent the formation of intermetallics in the Ti—Al system. Such intermetallic phases, if they are formed, close open pores in the Ti preform and stop the infiltration process. So, a low infiltration temperature stipulating low activity of the reaction between Ti and Al is a very important point of our innovation to prevent formation of intermetallics and provide successful infiltration.

On the other hand, we need intermetallics to enhance the reinforcing skeleton of the composite and to obtain the dispersion-strengthening structure of the final product. The hot deformation (e.g., hot rolling) after the infiltration has a secondary object, —to complete the solid phase reactions between Ti, Al and other alloying components and to form intermetallics in a quantity effective for the composite strengthening. This deformation step provides not only the formation of skeleton-forming and dispersed intermetallic phases but also their uniform distribution in the composite structure.

Thus, the essence of the innovative processing chain "deformation-low temperature infiltration-deformation" is the prevention of intermetallic formation during the infiltration into prepared small-size pores and then stimulation of intermetallic formation and distribution of strengthening phases during hot and cold deformation.

This deformation may also be performed in several runs to reach a desirable deformation level without destruction of the infiltrated composite preform. Each deformation stage may be accompanied by a stress-relieving heat treatment.

Re-sintering or diffusion annealing of the infiltrated and deformed composite is the finalizing step of the structure control. This procedure completes densification, forms additional strengthening intermetallics, fixes the final grain size and size of dispersed phases, and releases residual stresses after the previous deformation. This treatment can be also used to grow the grain size and the size of dispersed phases if necessary.

So, the innovative technology provides control of the IMMC structure at all stages of the manufacturing process—starting from the first deformation stage. The controlled structure of lightweight IMMC not only results in a significant improvement of its mechanical and working characteristics but also makes it possible to manufacture construction articles for various industrial purposes.

The invention will be further clarified by the following examples.

EXAMPLE 1

The CP titanium powder having a particle size of −100 mesh was loose sintered at 1100° C. (2000 F.) in the flat preform having sizes of 6"×12"×0.125". The skeleton structure, having a density of 35% obtained after loose sintering was cold rolled to an average density of ~50%. The infiltrating alloy with a composition of Mg—50 wt. %Al was placed on the preform in a graphite crucible and heated in vacuum to 600° C. (1110 F.) to infiltrate said titanium skeleton structure. The obtained composite material was fully dense with a measured density of 2.87–2.89 g/cm$^3$.

Specimens 3"×0.5" were cut out from the edge and central part of the sheet to measure hardness and flexure strength. The thickness of specimens was in the range of 0.078–0.125" depending on the preset deformation.

The particle size of titanium powder, sizes of initial powder preforms, loose sintering temperature, and sizes of specimens for mechanical testing were the same in all examples described below.

Mechanical properties of the composites are shown in Table 1.

EXAMPLE 2

The same skeleton structure as in Example 1 was manufactured and infiltrated with the same Mg—50Al alloy melt. The infiltrated sheet was cold rolled to a 30% reduction. The resulting composite material had a measured density of 3.03–3.07 g/cm$^3$ with a fully dense textured microstructure.

EXAMPLE 3

The same skeleton structure as in Example 1 was manufactured and infiltrated with the same Mg—50Al alloy melt. The infiltrated sheet was annealed for 4 h at 400° C. (760 F.) in vacuum to promote the formation of strengthening intermetallic phases. Measured density of the resulting composite was 2.86–2.89 g/cm$^3$.

EXAMPLE 4

The same skeleton structure as in Example 1 was manufactured and infiltrated with the same Mg—50Al alloy melt. The infiltrated sheet was hot rolled at 350° C. (660 F.) to 30% reduction. The resulting composite material had a measured density of 3.03–3.06 g/cm$^3$ with a fully dense textured microstructure.

EXAMPLE 5

The powder of Ti—6Al—4V alloy was die pressed in the shape of a hexagonal nut to a ~50% density and sintered at 2000 F. The obtained skeleton structure having a density of ~65% was infiltrated with the Mg—50Al melt. The infiltrated composite article was placed in the mold and forged to a 20% reduction followed by re-sintering. Pores had a flattened shape with the long axis perpendicular to the direction of forging (FIG. 5). The resulting composite material had a measured density of 3.22–3.23 g/cm$^3$ with a fully dense textured microstructure.

EXAMPLE 6

The CP titanium powder was loose sintered in the skeleton structure having a density of ~34%, and then was infiltrated with molten Pb in vacuum at 450° C. (840 F.). The infiltrated sheet was cold rolled to a 30% reduction. The resulting composite material had a fully dense textured microstructure and smooth surface.

EXAMPLE 7

The CP titanium powder was loose sintered in the skeleton structure having density of 35%. The sintered preform was hot rolled at 350° C. (600 F.) to average density of 66% with a porosity of ~32% near the surface. Pores had a flattened shape with the long axis collateral to the direction of rolling (FIG. 2). The powder of infiltrated alloy containing Al 33, Nb 2, Si 1 wt. %, and Mg in the balance was placed on and under the titanium preform and heated together to 490–500° C. in vacuum and held for 20 min at this temperature. The infiltrated composite plate was cooled and processed by several runs of hot rolling at 380° C. to achieve the plate thickness of 0.078"±0.04". Then, the obtained composite preform was annealed for 2 h at 420° C. The surface of the resulting composite plate was dense, flat, and smooth.

Study of the microstructure showed a fully dense structure, fine textured grains, with the presence of dispersed aluminides and silicides.

EXAMPLE 8

The CP Ti powder was loose sintered in the skeleton structure having a density of ~32%. The sintered preform was cold rolled by 3 runs to the average density of 61% with a porosity of ~35% near the surface. Pores had a flattened shape with the long axis collateral to the direction of rolling. The powder of infiltrated alloy containing Al 50, Zr 1, Si 1 wt. %, and Mg in the balance was mixed with 2 wt. % of a sub-micron $TiB_2$ powder having a particle size of <0.5 $\mu$m, placed on and under the titanium preform plate, and heated together to 500–520° C. in vacuum and held for 20 min at this temperature. The infiltrated composite preform plate was cooled and processed by several runs of hot rolling at 400° C. to achieve the plate thickness of 0.078"±0.04". Then, the obtained composite preform was annealed for 1 h at 420° C. The surface of the resulting composite plate was dense, flat, and smooth.

Study of the microstructure showed a fully dense structure, fine textured grains with the presence of dispersed aluminides and silicides. Improved mechanical characteristics obtained in Examples 7 and 8 (see Table 1) confirmed advantages of the new technology.

Comparative Example

The CP titanium powder having a particle size of −140 mesh was compacted in the plate preform by cold pressing and sintering at 1100° C. (2000 F.). The sintered preform had a density of about 60%. Pores had an irregular shape and distribution in the preform. The powder of infiltrated alloy containing 10 wt. % of Al and Mg in the balance (that is described in JP 01279715, JP 09263858, and WO 9117278) was placed on and under the titanium preform plate, and heated together to 680–700° C. in vacuum and held for 20 min at this temperature. The infiltrated composite preform plate was cooled and tested.

Samples having the same size as in the example 1 were prepared. The sample surface was ground and polished to remove local defects and residues of Mg—Al alloy that were not infiltrated into the composite. Study of the microstructure showed residual porosity averages of ~9% but in the central area of the plate ~14% including large agglomerated pores. All pores were distributed irregularly through the composite cross-section and had different shapes and sizes. Mechanical properties of the composite are shown in Table 1. Some of samples were broken at very small bending loading.

TABLE 1

Mechanical properties of infiltrated metal matrix composite plates

| Example | Powder compact | Infiltrating alloy | Hardness, HB | Flexure strength, ksi (Mpa) |
|---|---|---|---|---|
| 1 | CP Ti | Mg-50Al | 61–63 | 24 (166) |
| 2 | CP Ti | Mg-50Al | 67–69 | 26 (179) |
| 3 | CP Ti | Mg-50Al | 44–46 | 21( 145) |
| 4 | CP Ti | Mg-50Al | 67–71 | 26 (179) |
| 5 | Ti-6Al-4V | Mg-50Al | 80–88 | 26 (179) |
| 7 | CP Ti | Mg-33Al-1Si-2Nb | 79–84 | 31 (214) |
| 8 | CP Ti | Mg-50Al-1Si-1Zr | 74–76 | 33 (228) |
| compar. example | CP Ti | Mg-10Al | <20 | <8 (55) |

We claim:

1. The manufacture of metal matrix composites containing 10–99 wt. % of permeable skeleton structure of titanium, titanium aluminide, titanium-based alloys, and/or mixtures thereof, and 1–90 wt. % of low-melting metal infiltrating said skeleton structure includes the steps of:

(a) forming the permeable metal powder into the skeleton structure by loose sintering in vacuum, or direct powder rolling, die pressing, and/or cold isostatic pressing followed by sintering in vacuum or low-pressure sintering in an inert gas, or combinations thereof to provide the average porosity of 20–70%, (b) deformation of the skeleton structure by cold or hot rolling, or forging to obtain a porous flat or shaped preform with a predetermined shape and size of pores and with the porosity gradually changing across the preform thickness, (c) heating the obtained porous preform and infiltrating metal in vacuum or in an inert gas atmosphere up to the infiltration temperature, (d) infiltrating the porous preform with molten infiltrating metal for 10–40 min at 300–1100° C., (e) deformation of the infiltrated composite preform by cold or hot rolling, hot isostatic pressing, coining, forging, or combinations thereof to refine microstructure of the infiltrated composite and transform it into the textured microstructure strengthened by intermetallic phases, (f) re-sintering or diffusion annealing activated by the deformation on the previous step.

2. The manufacture according to claim 1, wherein the infiltrating molten metal contains 1–70 wt. % of aluminum and magnesium in the balance.

3. The manufacture according to claim 1 or 2, wherein the infiltrating molten metal contains aluminum 1–70 wt. %, at least one metal selected from the group of titanium, silicon, zirconium, niobium, and/or vanadium 1–4 wt. %, and magnesium in the balance.

4. The manufacture according to claim 3, wherein the infiltrating molten metal contains additionally 0–3 wt. % of at least one dispersed powder selected from the group of $TiB_2$, SiC, and $Si_3N_4$ having a particle size of 0.5 $\mu$m or less, to promote infiltrating and wetting by Al-containing alloys.

5. The manufacture according to claim 1, wherein the obtained metal matrix composite contains 25–60 wt. % of titanium or titanium-based alloy and 40–75 wt. % of magnesium, magnesium-based alloy, or aluminum-based alloy.

6. The manufacture according to claim 1, wherein the deformation of the infiltrated composite preform is carried out by hot rolling at 300–550° C. to form TiAl, $Ti_3Al$, and $TiAl_3$ intermetallic phases realizing the strengthening of the composite material after the final deformation and heat treatment.

7. The manufacture according to claim 1, wherein the infiltrating metal is selected from the group of indium, tin, lead, bismuth, or alloys based on these metals.

8. The manufacture according to claim 1, wherein the infiltrating metal is selected from the group of silver, copper, or their alloys.

9. The manufacture according to claim 1, wherein the obtained metal matrix composite contains 25–60 wt. % of titanium-zirconium alloy and 40–75 wt. % of magnesium, magnesium-based alloy, or aluminum-based alloy.

10. The manufacture according to claim 1, wherein the infiltration of porous preform is carried out spontaneously in vacuum, by a pressure gradient, hot isostatic pressing, hot pressing, or under low pressure of an inert gas.

11. The manufacture according to claim 1 includes multiple deformations and annealing of the skeleton preform and infiltrated composite.

* * * * *